US006817389B2

(12) United States Patent
Dovesi

(10) Patent No.: US 6,817,389 B2
(45) Date of Patent: Nov. 16, 2004

(54) FEEDING UNIT FOR FEEDING SUBSTANCES, IN PARTICULAR POWDERY, GRANULAR AND SIMILAR SUBSTANCES, TO CONTAINERS

(76) Inventor: Pietro Dovesi, Via G. Leopardi 3, 40065 Pianoro (Bologna) (IT)

( * ) Notice: Subject to any disclaimer, the term of this patent is extended or adjusted under 35 U.S.C. 154(b) by 0 days.

(21) Appl. No.: 10/406,855

(22) Filed: Apr. 4, 2003

(65) Prior Publication Data

US 2004/0050449 A1 Mar. 18, 2004

(30) Foreign Application Priority Data

Sep. 17, 2002 (IT) ..... BO2002A0584

(51) Int. Cl.[7] ..... B65B 1/12

(52) U.S. Cl. ..... 141/145; 141/69; 141/72; 141/256; 141/286

(58) Field of Search ..... 141/67, 69, 71, 141/72, 256, 286, 145; 222/200, 239, 242

(56) References Cited

U.S. PATENT DOCUMENTS

| | | | | |
|---|---|---|---|---|
| 2,839,111 A | | 6/1958 | Mitchell | |
| 4,693,285 A | | 9/1987 | Chang | |
| 5,950,869 A | * | 9/1999 | Wegman | 222/1 |

FOREIGN PATENT DOCUMENTS

| | | |
|---|---|---|
| GB | 1 032 301 A | 6/1966 |
| JP | 2001 002224 | 1/2001 |

* cited by examiner

*Primary Examiner*—Gene Mancene
*Assistant Examiner*—Peter deVore
(74) *Attorney, Agent, or Firm*—William J. Sapone; Coleman Sudol Sapone, P.C.

(57) ABSTRACT

A unit for feeding powdery and/or granular products to containers includes a main body and a revolving funnel, through which the product reaches the main body. Driving means are provided for rotation of the revolving funnel with respect to the main body. Conveying and stirring means are carried by the funnel and driven into rotation within the main body to prevent formation of agglomerates.

16 Claims, 3 Drawing Sheets

FEEDING UNIT FOR FEEDING SUBSTANCES, IN PARTICULAR POWDERY, GRANULAR AND SIMILAR SUBSTANCES, TO CONTAINERS

BACKGROUND OF THE INVENTION

The present invention relates to the technical field of automatic lines for processing powdery, granular and similar substances, with particular reference to outlet units aimed at filling corresponding containers and/or bottles.

FIELD OF THE INVENTION

As regards the feeding of variable granulometry dosed substances, such as powders and/or granules, into corresponding containers, devices are well known to the men skilled in the art, which are capable of determining with high accuracy the fixed dosed amount, and which at their end sections are provided with suitable outlet units.

Such outlet units are conventionally formed of passage tubes, freely crossed by the fixed flow of doses, draining by suitably sized nozzles adapted for being inserted into, or facing, the mouths of the containers, for feeding them.

In the event of dosing of fixed amounts of granular and/or powdery substances, due to particularly small outlet sections of the end nozzles, so-called "bridges" may form into the corresponding passage tubes, that is, agglomerates of substances that hinder almost completely the flow of the same substances through the end nozzles.

The phenomenon that causes the formation of "bridges" and/or agglomerates into the passage tubes is strictly related to the nature and to the volume of the dosed substances, as well as to the chemical and physical working conditions inside the tubes themselves.

Such phenomenon is particularly frequent and burdensome when the container inlet sections and thereby the corresponding nozzle outlet sections are particularly small.

The situation is further worsened when particularly short times for filling the containers are required.

The difficulties of flow of the powdery and/or granular substances inside the tubes cause a considerable slowing down of the container filling step, and in some cases they even cause a stop of the flows of doses directed therein, with a further accumulation and clogging of the passage tubes.

Besides affecting the proper operation of the outlet units and of the associated packaging lines, discontinuous flows of the powdery and/or granular substances through the end nozzle outlet sections strongly limit the plant production rate and provide no guarantee as to the proper filling of the containers.

Such problems are especially felt in the food and pharmaceutical industry, where granular and/or powdery substances require an accurate dosing into the containers.

As a consequence, a reduction of the container inlet sections implies a reduction of the end nozzle outlet sections, with a high probability of formation of "bridges" and agglomerates into the passage tubes, and with a considerable limitation to the performance of the outlet units and of the packaging lines associated to them.

SUMMARY OF THE INVENTION

Object of the present invention is that of proposing a unit for feeding substances, in particular powdery, granular and similar substances, to corresponding containers, which should be capable of overcoming the disadvantages mentioned above and ensuring an optimum flow through the end sections of the same outlet unit, irrespective of the volume of the doses and of the nature of the substances.

A further object of the present invention is that of proposing a unit capable of limiting and preventing the formation of "bridges" and/or agglomerates by the treated powdery and/or granular substances, so as to ensure a proper filling of the corresponding containers.

Moreover, a further object of the invention is that of proposing an outlet unit which ensures high reliability and productivity standards in any working condition, irrespective of the nature of the dosed substance and of the chemical and physical working conditions into the same unit.

The above objects are achieved, according to the contents of the claims, by a feeding unit for feeding powdery and/or granular substances to containers, including:

a main body with an inlet mouth and a bottom portion, for receiving and conveying a flow of said substances;

one end nozzle joined to said bottom portion of said main body and designed for feeding said substances to said containers; the feeding unit further including:

conveying and stirring means turnably supported by said main body and extending inside said main body at least up to a region close to said end nozzle, for preventing formation of agglomerates into said flow of powdery and/or granular substance;

driving means for driving in rotation said conveying and stirring means with respect to said main body and in a space comprised within said main body and said end nozzle.

BRIEF DESCRIPTION OF THE DRAWINGS

The features of the invention will appear more clearly from the following description of some preferred but non-exclusive embodiments, made with reference to the attached drawings, wherein.

DISCLOSURE OF THE PREFERRED EMBODIMENT

Figure 2:
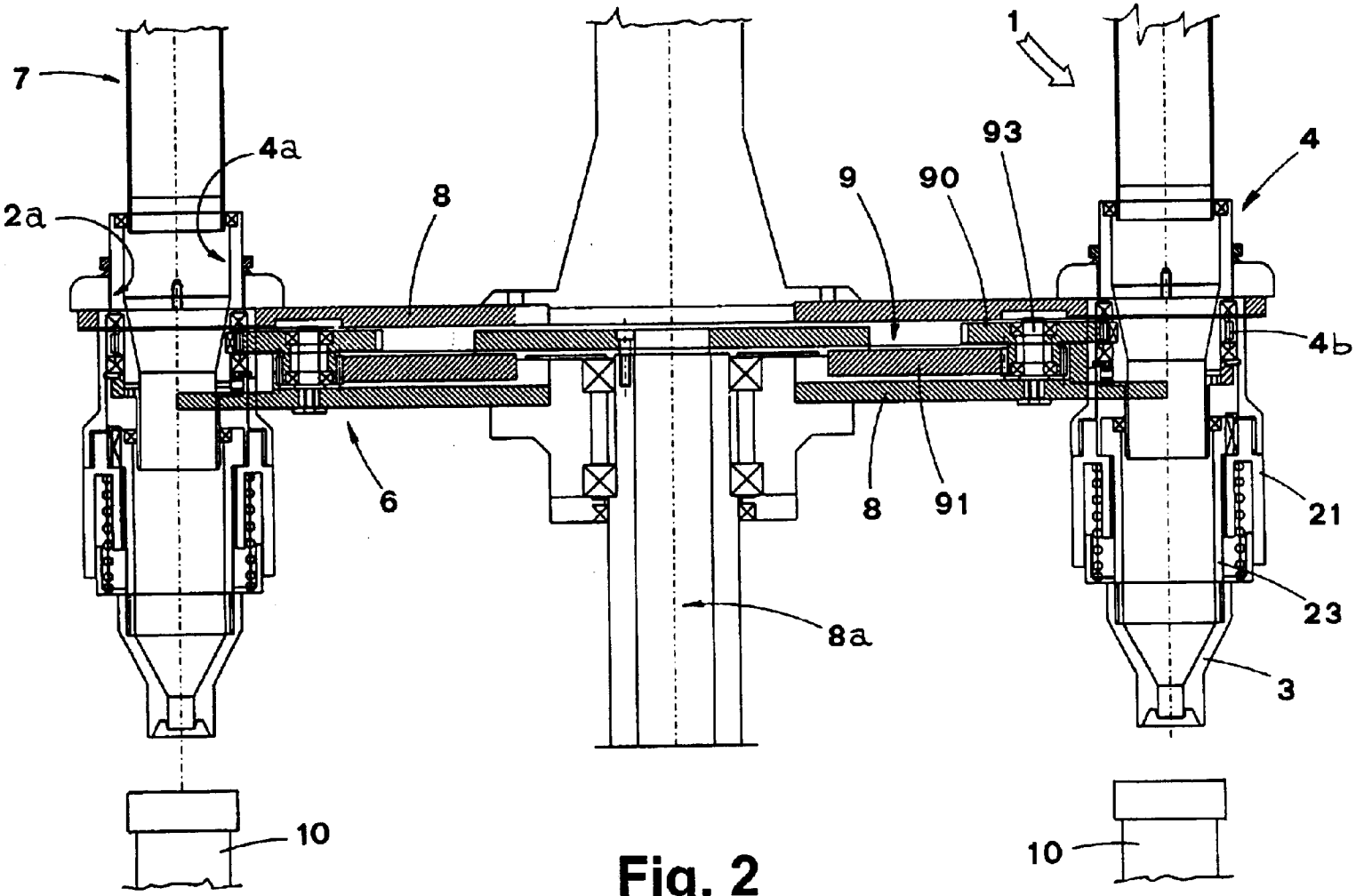

With reference to the above drawings, in relation to a particular embodiment provided by way of an example, the general reference numeral 1 indicates the outlet unit proposed herein for feeding powdery and/or granular substances, carried by a carrousel conveyor 8 revolving relative to the corresponding axis 8*a* (FIG. 2).

By way of an example, such outlet unit 1 is provided with a main body 2, supported by the carrousel conveyor 8, associated at its bottom side, for example by threading, to a sleeve 21 forming an annular chamber 21*a*, open at the side opposed to the main body 2.

At a relative annular abutment 21*b*, such sleeve 21 supports an inside tube 23, coaxial to it, connected at its bottom side, for example by threading, to an end nozzle 3 adapted for feeding the corresponding containers 10, substantially facing it.

The end nozzle 3, joined to the bottom portion of the inside tube 23, is capable of sliding relative to sleeve 21 against elastic means 3*a*, so as to arrange properly facing, or inserted into, the corresponding containers 10.

The elastic means 3*a*, for example consisting of a spring, are arranged into the annular chamber 21*a* provided by sleeve 21, with which they are in abutment at the top.

The inside tube 23 and the end nozzle 3 are crossed by a flow of powdery and/or granular substances, which are to fill the containers 10.

In the proximity of the relative mouth 2*a*, the main body 2 turnably supports a collecting member consisting of a revolving funnel 4 partly inserted into the inside tube 23, adapted for being crossed by the above flow of powdery and/or granular substances so as to allow them to freely pass through the same inside tube 23 and the relative end nozzle 3.

Upstream of funnel 4 there are provided dosing means 7, of known type, capable of feeding the mouth 4*a* of the same with a plurality of doses of powdery and/or granular substances.

Figure 1:
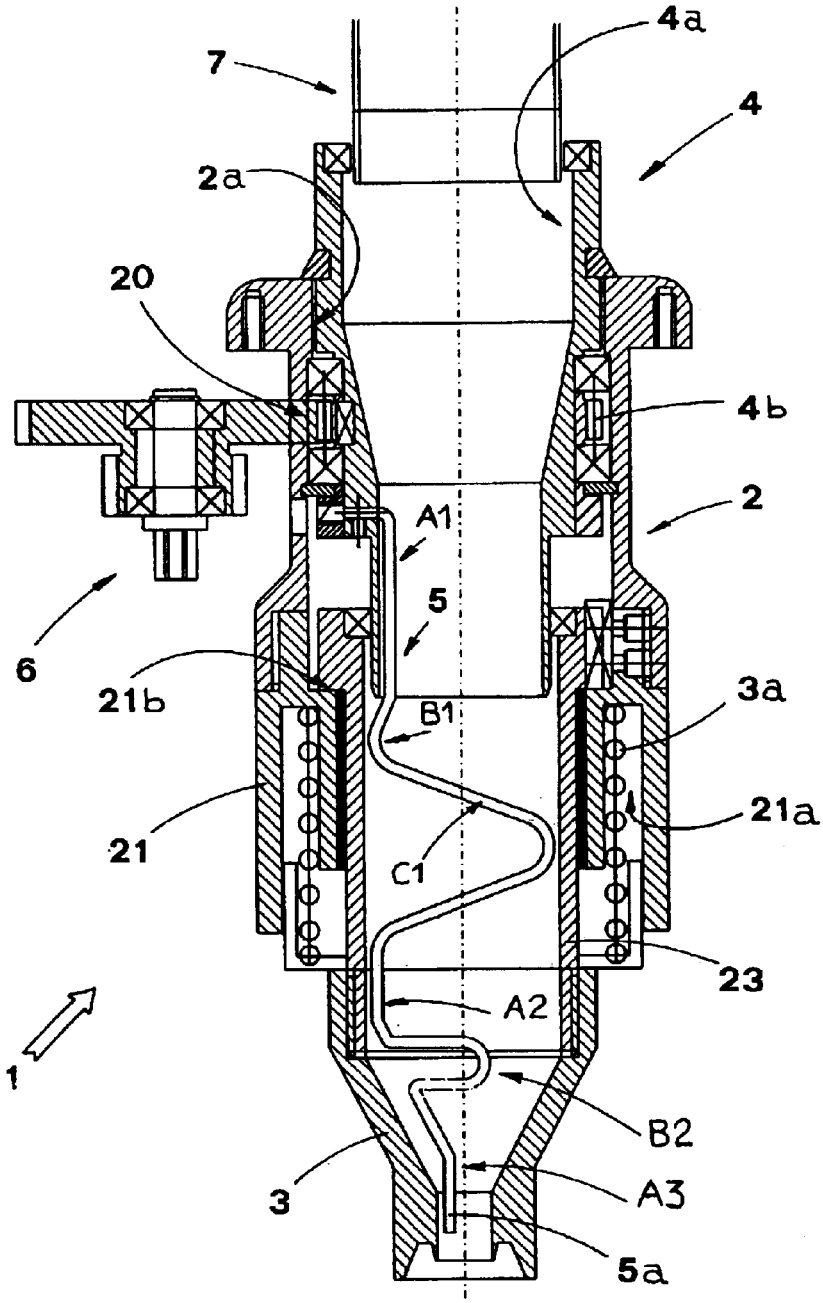
FIG. 1 schematically shows a side view according to an axial section, of the outlet unit proposed herein in a particular embodiment.

The revolving funnel 4 supports conveying and stirring means 5, for example consisting of a filiform element 5*a*, which extend into the inside tube 23 up to close the end nozzle 3, adapted for preventing the formation of agglomerates in the above flow of substances (FIG. 1).

The revolving funnel 4 is rotated relative to the main body 2 by driving means 6 so as to drive in stiff rotation the filiform element 5*a* within the spatial region comprised between the inside tube 23 and the relative end nozzle 3.

By way of an example, the driving means 6 comprise an driving gear 4*b*, fixed outside the revolving funnel 4, adapted for engaging with a linkage 9 actuated by the carrousel conveyor 8 revolving relative to axis 8*a*.

FIG. 2 shows one of the possible linkage 9 which provides for a pinion 90, turnably supported by a pin 93 integral with the carrousel conveyor 8, engaging with the driving gear 4*b* and with a toothed wheel 91, stationary relative to the revolving carrousel 8.

The main body 2, in particular, forms a lateral thorough groove 20 into which pinion 90 is inserted to allow the mutual engagement of the latter with the driving gear 4*b* associated to the revolving funnel 4.

The main body. 2 and the revolving funnel 4 are advantageously shaped according to relative cylindrical geometries coaxial to one another.

In particular, in order to increase the outflow speed of the powdery and/or granular substances, the revolving funnel 4 is shaped according to a truncated cone geometry, converging in the direction of the inside tube 23.

Into the inside tube 23, the filiform element 5*a* extends close to the relative wall so as to prevent the formation of "bridges" and or agglomerates close to the walls caused by the powdery and/or granular substances flowing therein.

Similarly, into the end nozzle 3, the filiform element 5*a* extends close to the relative wall so as to prevent the formation of agglomerates.

Advantageously, such filiform element 5*a* is shaped and extends according to a variable spatial configuration that provides for an alternation of spiral shaped portions (C1), rectilinear portions (A1, A2, A3), and curvilinear portions (B1, B2).

The helical portion (C1) allows an optimum stability of the filiform element 5*a* during the revolution and in the presence of stresses generated by the flow of powdery and/or granular substances, guaranteeing an effective preventive action against the formation of "bridges" and/or agglomerates.

The material forming the filiform element 5*a*, preferably of the flexible type, can be a stiff or a semi-flexible material.

Figure 1A:
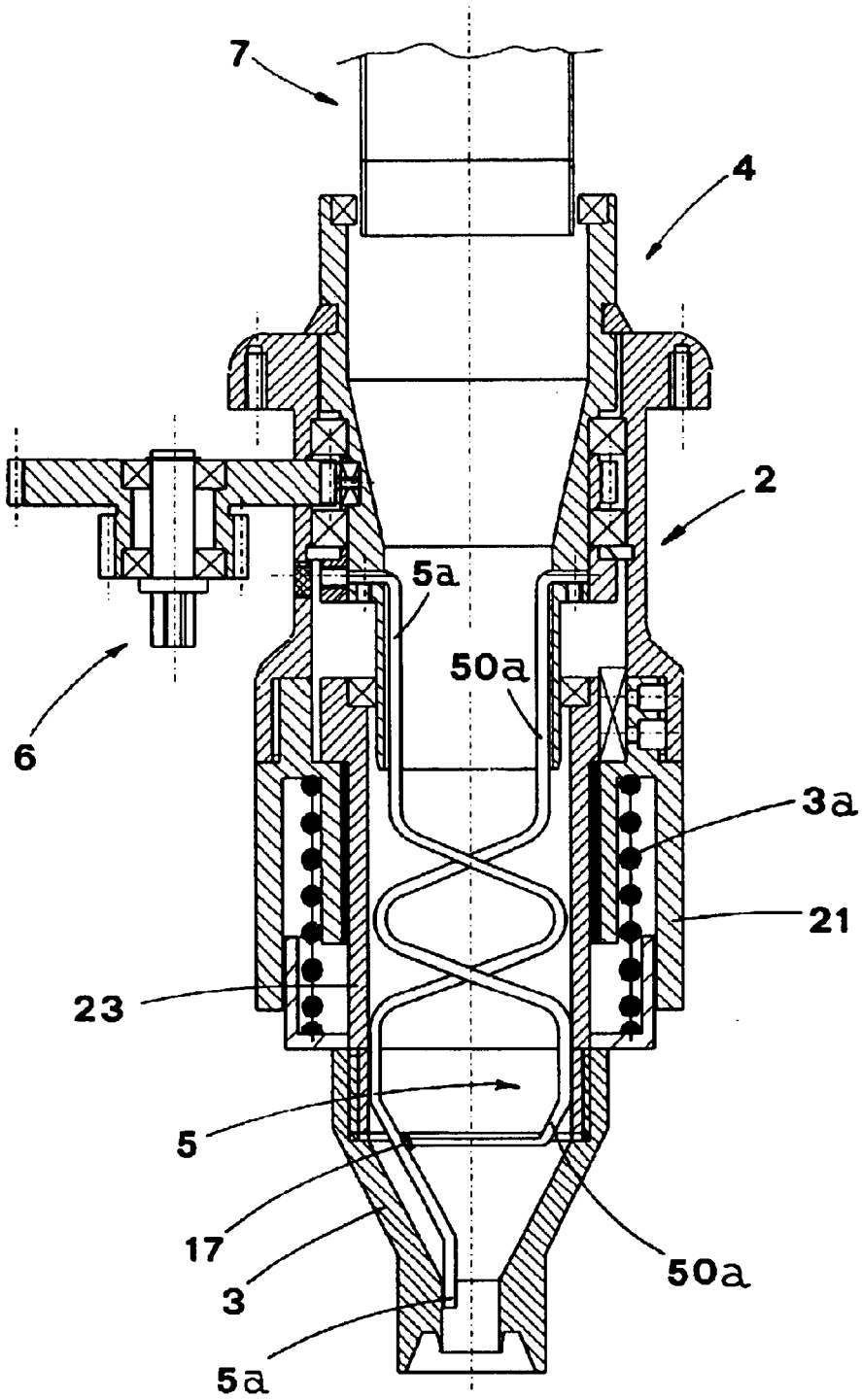
FIG. 1*a* schematically shows a side view according to an axial section, of the same outlet unit according to an interesting alternative embodiment FIG. 2 schematically shows a side view of one of the possible uses of the outlet unit shown in FIGS. 1, 1*a*.

FIG. 1 shows an embodiment that uses a single filiform element 5*a*, whereas FIG. 1*a* shows an alternative embodiment wherein a pair of filiform elements is used (5*a*, 50*a*), both supported by the revolving funnel 4, mechanically interconnected to one another.

The operation of the outlet unit 1 proposed herein, described hereinafter, is particularly simple and evident.

According to what said above, the revolution of axis 8*a* of the carrousel conveyor 8, by the interposition of the linkage 9, causes the revolution of the revolving funnel 4 relative to the main body 2, and thereby relative to the inside tube 23.

The actuation of the revolving funnel 4 drives in rotation the filiform element 5*a*, or multiple filiform elements 5*a*, that perform a dual action: scraping the internal walls of both the inside tube 23 and of the end nozzle 3, so as to prevent the formation of agglomerates of powdery and/or granular substances at the same; breaking any agglomerates that may form into the flow of powdery and/or granular substances that, released by the dosing means 7, cross the revolving funnel 4 and the inside tube 23 and flow into the end nozzle 3.

The dosed flow of powdery and/or granular substances exits from the inside tube 23 through the end nozzle 3 that is every time faced, or inserted, at the mouths of containers 10 to be filled.

In order to facilitate the coupling of the end nozzle 3 with the relative containers 10, the same slides axially, integrally with the inside tube 23 and in contrast with the elastic means 3*a*, relative to the sleeve 21, stiffly fixed to the bottom portion of the main body 2.

The unit proposed for feeding substances, in particular powdery, granular and similar substances, thereby ensures an optimum flow of the dosed substances through the end nozzle, irrespective of the volume of the doses and of the nature of the same substances, thus allowing a proper filling of the containers.

The possibility of quickly assembling the main body to the unit consisting of the sleeve, of the inside tube, of the elastic means and of the end nozzle, allows periodical cleaning and maintenance of the outlet unit of the invention at short time intervals.

The presence of the revolving filiform element into the inside tube, but above all in the proximity of the end nozzle, allows limiting and preventing, during the dispensing of the dosed substances, the formation of "bridges" and/or agglomerates by the same, so as to ensure a proper feeding of the relative containers and so as to favour the conveyance of the substances through the end nozzle.

The presence of a plurality of filiform elements mutually connected, for example at a connecting section 17, allows a higher stabilisation of the unit resulting during the revolution and more effective and long-lasting scraping and breaking up actions.

The revolving conveying and stirring means ensure a scraping action on the internal walls of the inside tube and of the end nozzle, so as to prevent the formation of agglomerates of powdery and/or granular substances at the same.

According to a further embodiment, the outlet unit proposed herein can be advantageously realised according to a simple geometry that provides for the main unit as capable of turnably supporting the revolving funnel and of directly carrying the end nozzle, without the interposition of the sleeve and of the inside tube.

In this case, the powdery and/or granular substances coming out of the dosing means directly pass through the revolving funnel and the central body, exiting from the end nozzle facing the containers.

The conveying and stirring means, which can consist of a plurality of filiform elements 5*a* with a variable spatial configuration, supported by the revolving funnel, can be independent of one another or mechanically connected during the rotation, at the connecting section 17.

In the case of mechanically connected filiform elements, a higher stabilisation of the unit during the rotation and a particularly effective scraping and breaking up action are ensured (FIG. 1*a*).

In place of the linkage actuated by the revolving carrousel conveyor, the driving means can provide for any actuating means capable of engaging with the driving gear fixed to the revolving funnel and driving the latter in rotation.

According to a further embodiment, the conveying and stirring means consisting of one or more filiform elements, can be turnably supported by the main body and directly actuated in rotation by the driving means, without the interposition of the revolving funnel.

In this case, the dosing means directly dispense the powdery and/or granular substances to the central body, suitably shaped as a funnel, inside which the conveying and stirring means rotate.

What is claimed is:

1. A feeding unit for feeding powdery and/or granular substances to containers comprising:

a main body with an inlet mouth and a bottom portion, for receiving and conveying a flow of said substances;

one end nozzle joined to said bottom portion of said main body for feeding said substances to said containers;

conveying and stirring means turnably supported by said main body and extending inside said main body, at least in part close to an inner wall of said main body, and extending inside said end nozzle at least in part to an inner wall of said end nozzle to prevent formation of agglomerates from said powdery and/or granular substances;

driving means for driving in rotation said conveying and stirring means with respect to said main body in a space within said main body and said end nozzle;

said conveying and stirring means having a plurality of filiform elements with variable spatial configurations which are connected to one another at least in one connecting section.

2. The unit according to claim 1, wherein each filiform element of said plurality of filiform elements includes at least one curvilinear portion, or at least one spiral-shaped portion and at least one curvilinear portion.

3. The unit according to claim 1, wherein each filiform element of said plurality of filiform elements includes at least one portion selected from the group consisting of at least one rectilinear portion, at least one curvilinear portion, at least one spiral-shaped portion, and combinations thereof.

4. The unit according to claim 1, wherein said conveying and stirring means are constituted by a pair of filiform elements with variable spatial configuration which are connected one to another in one connecting section located inside said end nozzle, a first filiform element of said pair of filiform elements including a first rectilinear portion near an inner wall of said main body, a second spiral-shaped portion extending inside said main body, a third rectilinear portion near an inner wall of said main body, a forth rectilinear portion extending inside said end nozzle and a fifth rectilinear portion near an inner wall of said end nozzle, and a second filiform element of said pair of filiform elements including a first rectilinear portion near an inner wall of said main body, a second spiral-shaped portion extending inside said main body, a third rectilinear portion near an inner wall of said main body, a fourth further rectilinear portion extending inside of said main body and said end nozzle and a fifth rectilinear portion extending inside said end nozzle and ending in correspondence to said connecting section.

5. The unit according to claim 1, wherein said filiform elements are made from a semi-flexible material, a stiff material, or a flexible material.

6. The unit according to claim 1, further comprising at least one collecting member turnably supported by said main body and at least partially inserted into said inlet mouth for receiving the flow of substances and allowing free passage of the substances therethrough and through the main body; said collecting member being capable of supporting said conveying and stirring means and being driven in rotation with respect to the main body by said driving means to cause rotation of the conveying and stirring means.

7. The unit according to claim 6, wherein said main body and said collecting member are shaped according to a substantially cylindrical geometry and are coaxial with one another, said collecting member being shaped according to a frusto-conical geometry converging in a direction of said main body.

8. The unit according to claim 6, further comprising dosing means disposed upstream of said collecting member for feeding an inlet mouth of said collecting member with a plurality of doses of said powdery and/or granular substances.

9. The unit according to claim 6, wherein said collecting means consist of a rotary funnel turnably supported by said main body.

10. The unit according to claim 1, further comprising a sleeve removably joined to a bottom portion of said main body, said sleeve supporting an inside tube, coaxial with the sleeve, removably joined, at a bottom portion, to the end nozzle.

11. The unit according to claim 10, further comprising elastic means interposed between said end nozzle and said sleeve, for allowing reciprocal sliding, with respect to said sleeve, of the end nozzle and the inside tube joined to the end nozzle.

12. The unit according to claim 11, further comprising an annular chamber formed within said sleeve for receiving and biasing said elastic means.

13. A feeding unit for feeding powdery and/or granular substances to containers, comprising:

a main body having an inlet mouth and a bottom portion for receiving and conveying a flow of said substances;

one end nozzle joined to said bottom portion of said main body for feeding said substances to said containers;

conveying and stirring means turnably supported by said main body and extending inside said main body, at least in part close to an inner wall of said main body, and extending inside said end nozzle, at least in part to an inner wall of said end nozzle, to prevent formation of agglomerates from said powdery and/or granular substances;

driving means for driving in rotation said conveying and stirring means with respect to said main body in a space within said main body and said end nozzle;

said conveying and stirring means having a plurality of filiform elements with variable spatial configuration which do not interact with one another.

14. The unit according to claim 13, wherein each filiform element of said plurality of filiform elements includes at least one curvilinear portion, or at least one spiral-shaped portion and at least one curvilinear portion.

15. The unit according to claim 13, wherein each filiform element of said plurality of filiform elements includes at least one portion selected from the group consisting of at least one rectilinear portion, at least one curvilinear portion, at least one spiral-shaped portion, and combinations thereof.

16. The unit according to claim 13, wherein said filiform elements are made from a semi-flexible material, a stiff material, or a flexible material.

* * * * *